United States Patent [19]

Schneider

[11] Patent Number: 4,565,068

[45] Date of Patent: Jan. 21, 1986

[54] TURBOCHARGER

[75] Inventor: Wilfried Schneider, Glashütten, Fed. Rep. of Germany

[73] Assignee: Klöckner-Humboldt-Deutz AG, Cologne, Fed. Rep. of Germany

[21] Appl. No.: 573,498

[22] Filed: Jan. 24, 1984

[30] Foreign Application Priority Data

Jan. 24, 1983 [DE] Fed. Rep. of Germany ..... 3302186

[51] Int. Cl.[4] ..... F02B 37/00

[52] U.S. Cl. ..... 60/602; 60/605; 415/205

[58] Field of Search ..... 60/602, 605, 600, 601, 60/603; 415/205

[56] References Cited

U.S. PATENT DOCUMENTS

| | | | |
|---|---|---|---|
| 3,231,238 | 1/1966 | Hoffstrom | 415/205 |
| 3,844,676 | 10/1974 | Betteridge | 415/205 |
| 4,177,006 | 12/1979 | Nancarrow | 415/205 |
| 4,389,845 | 6/1983 | Koike | 60/602 |

FOREIGN PATENT DOCUMENTS

| | | | |
|---|---|---|---|
| 2844530 | 4/1979 | Fed. Rep. of Germany | 415/205 |
| 1044176 | 9/1966 | United Kingdom | 415/205 |

*Primary Examiner*—Douglas Hart

*Attorney, Agent, or Firm*—Watson, Cole, Grindle & Watson

[57] ABSTRACT

A turbocharger for an internal combustion engine has a turbine casing including an inlet opening from which radially internally and radially external spiral paths extend. These spiral paths have a common partition, and the exhaust gas inlet cross-section of the turbine casing can be varied by a control element for the purpose of adapting the characteristic curve of the turbocharger to different operating ranges of the internal combustion engine. And, the spiral paths are in hydrodynamic communication through orifice areas provided in the partition, with such orifice areas being spaced an equal distance from one another in the direction of flow of the exhaust gas, and the spiral paths extend substantially over the entire peripheral area of the turbine wheel.

6 Claims, 3 Drawing Figures

TURBOCHARGER

BACKGROUND OF THE INVENTION

This invention relates to a turbocharger for an internal combustion engine, and includes a turbine casing surrounding a turbine wheel, the turbine casing having an inlet and an outlet for the exhaust gases of the internal combustion engine and having on the inlet side, arranged substantially concentrically with the turbine wheel, a radially internal spiral path and at least one radially external spiral path, the paths having a common partition and the cross-section of the exhaust gas inlet being varied by the provision of a control element.

During operation, this type turbocharger can be adapted by varying the cross-section of the exhaust-gas inlet by the control element to therefore adapt the exhaust gas velocity in the turbine casing to different operating ranges of the internal combustion engine, for example, part-load operation or full-load operation. In such arrangement the control element is preferably actuated as a function of the charge-air pressure or of the rpm of the internal combustion engine by the provision of suitable control means.

A similar type turbocharger for internal combustion engines is disclosed in West German patent application No. 31 05 179, wherein a total of three spirals are arranged radially outwardly of internal spirals which can be unblocked and blocked individually by separate control members, and the exhaust gases flowing therethrough impinge directly upon different peripheral areas of the turbine wheel. Aside from the relatively complex and costly structure required for this type turbocharger, such arrangement possesses a significant drawback in the loss-intensive partial admission of the turbine wheel occuring with different rpms of the internal combustion engine or with varying charge-air pressures. Furthermore, the necessary control effort to be produced for the three separate control elements in order to adapt the characteristic curve of the turbocharger to the particular operating range of the internal combustion engine, is substantial.

SUMMARY OF THE INVENTION

It is therefore an object of the present invention to improve upon the turbocharger for an internal combustion engine of the aforedescribed type such that, with a simple structural arrangement and while avoiding a loss-intensive partial admission of the turbine wheel during operation, it is possible to effectively adapt the turbocharger to different operating ranges of the internal combustion engine.

This objective is achieved in accordance with the invention in that the internal and external spiral paths are in hydrodynamic communication through orifice areas located in the common partition and spaced from one another in the direction of the exhaust gas flow through such paths, the internal and external spiral paths extending substantially over the entire peripheral area of the turbine wheel. As a result, it is advantageously possible, regardless of the position of the control element at the inlet of the turbine casing, and thus independent of the operating range of the internal combustion engine, to impinge uniformly upon the entire peripheral area of the turbine wheel. Therefore, during operation in which a maximally unblocked exhaust-gas area of the exhaust gas flowing through the radially external spiral path is allocated to the entire peripheral area of the turbine wheel, a partial current escapes through the orifice areas and impinges directly on the turbine wheel, and the escaping partial current of the external spiral path also affects the flow of the radially internal spiral path so as to change the inflow angle of the turbine wheel. In such manner, by utilizing a simple structural arrangement and a minimized control effort over the entire operating range of the internal combustion engine, it is possible to adapt the characteristic curve of the turbocharger to different operating ranges of the internal combustion engine with the object of optimizing its overall efficiency.

Preferably, the orifice areas in the direction of flow of the exhaust gas are spaced apart an equal angular distance from each other relative to the turbine wheel axis.

More particularly, in order to maintain constant the flow velocity of the exhaust gas in the external spiral path despite the partial current branched off through the orifice areas, an improvement according to the invention provides for a decrease in the flow area of the radially external spiral path in a direction of flow of the exhaust gas.

Further according to the invention, the common partition can be effected from the standpoint of fluid mechanics and production engineering. Thus, for example, the partition comprises a plurality of wall segments which are radially offset in the direction of flow of the exhaust gas thereby resulting in the formation of the orifice areas. And, the individual wall segments may be so arranged to effect a constant flow area between pairs of adjacent orifice areas. The flow area of the radially internal spiral path therefore diminishes in steps, whereby the particular step cross-sections are adapted to the branched-off partial currents so as to obtain a substantially constant flow velocity.

Further objects, advantages and novel features of the invention will become more apparent from the following detailed description of the invention when taken in conjunction with the accompanying drawings.

DETAILED DESCRIPTION OF THE INVENTION

Figure 1:
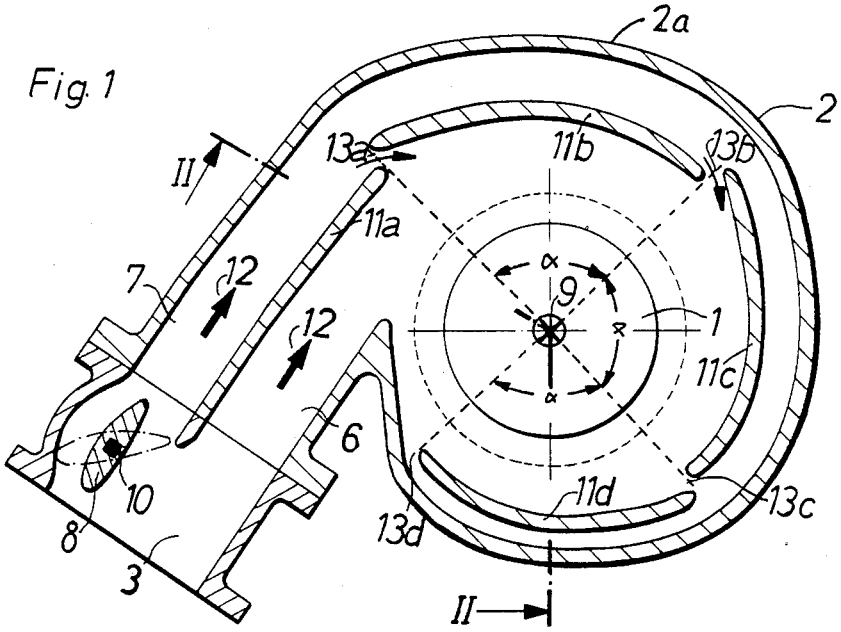
FIG. 1 is a horizontal sectional view taken through a first embodiment of the turbocharger in accordance with the invention.

Turning now to the drawings wherein like reference characters refer to like and corresponding parts throughout the several views, the turbocharger of the invention includes a conventional turbine-wheel 1 (FIG. 1) which has a surrounding turbine casing 2. This turbine casing has an inlet opening 3 and an outlet opening 4 which, in a manner not shown in detail, can be connected to the exhaust gas line of an internal combustion engine in any normal manner. The turbocharger further comprises a compressor 5 arranged coaxially with turbine wheel 1, but which forms no part of the invention. Turbine casing 2 includes a radially internal spiral path 6 and a radially external spiral path 7, each such spiral path communicating with inlet opening 3. The radially external spiral path 7 is governed by a control element which, in the FIG. 1 embodiment, is in the form of a flap valve 8 and, in the FIG. 3 embodiment, is in the form of a rotary valve 15. To change the inlet cross-section, flap valve 8 is pivoted by any known means (not shown) about its center-of-gravity axis 10 which lies parallel to central axis 9 of the turbine wheel. Radially internal spiral path 6 and radially external spiral path 7 have a common partition 11 comprised of several individual wall segments 11*a*, 11*b*, 11*c*, 11*d*. These individual wall segments are so designed and arranged in the direction of flow 12 of the exhaust gas through the turbocharger that spiral path 6 and spiral path 7 are in hydrodynamic communication through orifice areas 13*a*, 13*b*, 13*c* and 13*d*, adjacent pairs of such orifice areas being spaced apart an angular distance $\alpha$ from one another relative to turbine wheel axis 9. As specifically shown in FIGS. 1 and 3, wall segments 11*a* to 11*d* are radially offset to define the orifice areas between adjacent pairs of such segments. Thus, wall segment 11*b* is spaced closer to outer wall 2*a* of the casing as compared to the spacing of wall segment 11*a* therefrom, wall segment 11*c* is spaced closer to outer wall 2*a* as compared to wall segment 11*b*, and wall segment 11*d* is spaced closer to outer wall 2*a* as compared to wall segment 11*c*. It should be noted that, of course, orifice area 13*d* is formed between the downstream end of wall segment 11*d* and the adjacent outer wall 2*a* of the casing. Moreover, the relative spacings of the several wall segments are constant between upstream and downstream ends thereof from outer wall 2*a* of the casing. By reason of such spacings of the wall segments, and the respective constant spacings thereof, the flow area of the radially external spiral path 7 diminishes in the direction of flow 12 of the exhaust gas, and the flow area of the radially external spiral path 7 is constant between pairs of adjacent orifice areas. Moreover, the radially internal spiral path 6 and the radially external spiral path 7 extend substantially over the entire peripheral area of the turbine wheel, so that it is possible to impinge uniformly upon the entire peripheral area of the turbine wheel in all operating ranges of the internal combustion engine.

During operation of the turbocharger, orifices 13*a* to 13*d*, with control element 8 or 15 closed, cause only a slight disturbance in the volume of exhaust gas flowing through radially internal spiral path 6, so that turbine wheel 1 is impinged upon uniformly over the periphery at a substantially constant inflow angle. A continuous enlargement of the inlet 3 cross-section and, therefore, a continuous unblocking of the flow area of the radially external spiral path 7 for the purpose of adapting the characteristic curve of the turbocharger to higher rpms of the internal combustion engine, result in a partial current of exhaust gas traveling through orifices 13*a* to 13*d* from the radially external spiral path 7 into the radially internal spiral path 6, with the velocity of flow of the exhaust gas in path 7 through the constricted orifices 13*a* to 13*d* remaining substantially constant, so that the current in the radially internal spiral path 6 is controlled with the object of varying the in flow angle of turbine wheel 1. Thus, the particular partial exhaust gas current concerned advantageously contributes to the uniform impingement of turbine wheel 1 over the entire peripheral area thereof.

Figure 2:
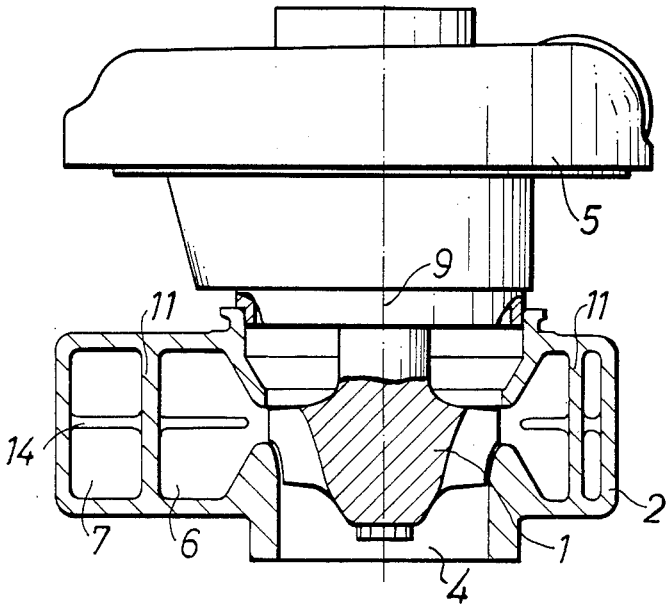
FIG. 2 is a partially sectioned view taken substantially along the line II—II of FIG. 1.

As illustrated in FIG. 2, spiral paths 6 and 7 may be divided into a pair of ducts by a wall 14 lying perpendicular to turbine wheel axis 9. This is of particular interest for multicylindrical reciprocating internal combustion engines.

Figure 3:
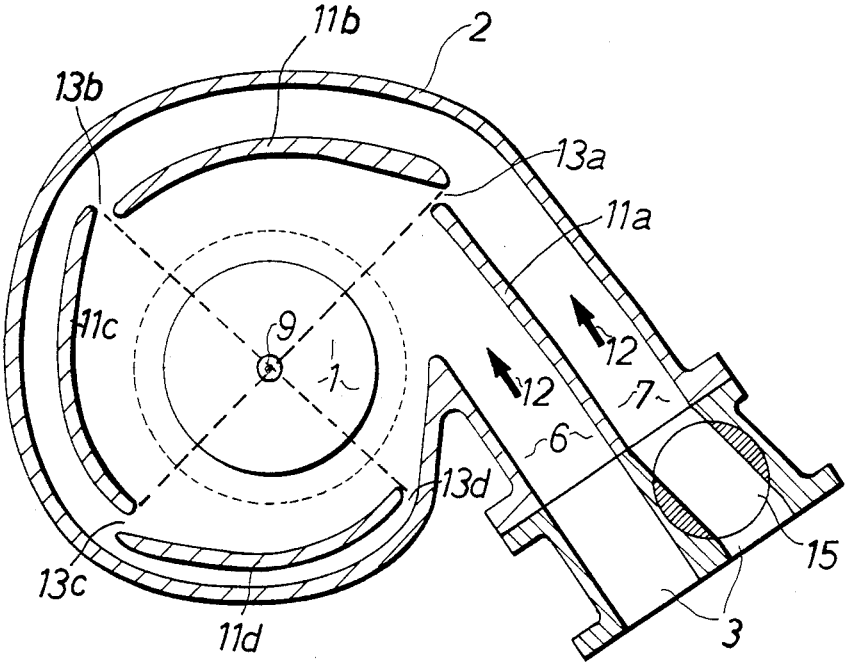
FIG. 3 is a view similar to FIG. 1 of another embodiment according to the invention.

In the FIG. 3 embodiment, the control element for varying the cross-section of inlet 3 comprises a rotary valve 15. With the use of such a valve, the adjusting forces of the control element can be maintained low because of the minimized flow resistances, and it can substantially reduce the influences of the control element on the inlet current, as for example, vortexings. This can be of great importance for the turbocharger embodying the principles of the invention.

Obviously, many other modifications and variations of the present invention are made possible in the light of the above teachings. It is therefore to be understood that within the scope of the appended claims the invention may be practiced otherwise than as specifically described.

What is claimed is:

1. An exhaust-driven turbo-supercharger for an internal combustion engine, comprising a turbine wheel and a turbine casing surrounding said wheel, said casing having an inflow opening and an outflow opening for the flow of exhaust gases of the engine, said casing having at the inflow side thereof means substantially concentric with the axis of the turbine wheel defining a radially internal spiral path and a radially external spiral path, said paths having inlets opening into said inflow opening of the exhaust-driven turbo-supercharger, a control element for varying the cross-section of said inlet of said radially external path, said means comprising a common partition wall rigidly mounted to said casing, said wall extending about the entire circumferential area of said turbine wheel, the flow cross-section of said radially external path decreasing in the direction of flow of the exhaust, said partition wall in the direction of exhaust flow having a plurality of orifice areas located one behind the other for interconnecting the flow between said internal and external paths, and said orifice areas being spaced apart an equal angular distance from one another in the exhaust flow direction relative to said turbine wheel axis.

2. The turbocharger according to claim 1, wherein said partition comprises a plurality of separate wall segments which are radially offset in the flow direction for thereby defining said orifice areas.

3. The turbocharger according to claim 1, wherein said partition is spaced from an outer wall of said casing for establishing a constant flow area of said radially external spiral path between adjacent pairs of said orifice areas.

4. The turbocharger according to claim 2, wherein said wall segments are each spaced a constant distance from an outer wall of said casing for establishing a constant flow area of said radially external spiral path between adjacent pairs of said orifice areas.

5. The turbocharger according to claim 1, wherein said control element comprises a rotary valve for controlling the exhaust gas flowing through said radially external spiral path.

6. The turbocharger according to claim 1, wherein said casing includes a divider wall lying perpendicular to said turbine wheel axis for dividing each of said flow paths into a pair of ducts.

* * * * *